US007784534B2

(12) United States Patent
White et al.

(10) Patent No.: US 7,784,534 B2
(45) Date of Patent: Aug. 31, 2010

(54) SEALED DRIVE FOR A ROTATING SUCKER ROD

(75) Inventors: Billy W. White, Spring, TX (US); Michael J. Guidry, Jr., Hockley, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 0 days.

(21) Appl. No.: 12/077,602

(22) Filed: Apr. 22, 2008

(65) Prior Publication Data

US 2009/0260800 A1 Oct. 22, 2009

(51) Int. Cl.
*E21B 43/12* (2006.01)

(52) U.S. Cl. ..... 166/68.5; 166/66.5; 166/78.1; 166/75.11; 166/104

(58) Field of Classification Search ..... 166/68.5, 166/75.13, 84.1, 66.5
See application file for complete search history.

(56) References Cited

U.S. PATENT DOCUMENTS

| | | | | |
|---|---|---|---|---|
| 4,372,379 A | | 2/1983 | Kulhanek et al. | |
| 4,647,050 A | | 3/1987 | Johnson | |
| 5,090,944 A | * | 2/1992 | Kyo et al. | 464/29 |
| 5,217,068 A | | 6/1993 | Newton | |
| 5,327,961 A | | 7/1994 | Mills | |
| 5,343,944 A | | 9/1994 | Bassinger | |
| 5,567,138 A | | 10/1996 | Newton | |
| 5,791,411 A | | 8/1998 | Ricalton et al. | |
| 5,865,245 A | | 2/1999 | Trout et al. | |
| 6,371,487 B1 | * | 4/2002 | Cimbura, Sr. | 277/322 |
| 6,637,509 B2 | | 10/2003 | Farquharson et al. | |
| 6,843,313 B2 | | 1/2005 | Hult | |
| 7,001,063 B1 | * | 2/2006 | Markle | 417/420 |
| 7,044,217 B2 | | 5/2006 | Hult | |
| 7,055,593 B2 | | 6/2006 | Lappin | |
| 2005/0000689 A1 | * | 1/2005 | Peleanu et al. | 166/279 |

* cited by examiner

*Primary Examiner*—David J. Bagnell
*Assistant Examiner*—Elizabeth C Gottlieb
(74) *Attorney, Agent, or Firm*—Browning Bushman P.C.

(57) ABSTRACT

A drive assembly for powering a rotating rod string (14) passing through a surface wellhead (18) includes a torque conveying housing (32) containing a radially outer member supporting a plurality of outer member magnets and rotated by a motor. A radially inner member (48) supports a plurality of inner member magnets and is rotatable within the outer member, with magnetic forces between the plurality of outer member magnets and the plurality of inner member magnets rotating the inner member magnets and thus the radially inner member.

8 Claims, 7 Drawing Sheets

SEALED DRIVE FOR A ROTATING SUCKER ROD

FIELD OF THE INVENTION

The present invention relates to drives for rotating a sucker rod commonly used in oil and gas operations, which conventionally use a stuffing box to seal fluid in the well. More particularly, this invention relates to a sealed drive for a rotating rod string which drives a downhole progressive cavity pump.

BACKGROUND OF THE INVENTION

Reciprocating downhole pumps have been used in the oil and gas industry for years to raise oil to the surface. In order to direct the oil flow at the surface of the well, a stuffing box is employed to seal around the reciprocating rod string. Stuffing boxes are commonly used for sealing with a reciprocating rod string.

Progressive cavity pumps rely upon the rotary action of the rod string rather than reciprocating action to power the downhole pump. Stuffing boxes for rotating rod strings commonly use conventional packing material as the sealing element, although some designs employ Chevron-type sealing elements.

The failure of a stuffing box is environmentally damaging and costly. Most often, failure results in spillage of oil at the well site, and well sites are thus commonly subject to expensive cleanup operations to eliminate hydrocarbons around the area of a well. Stuffing boxes also require a fairly high maintenance, and operators frequently are scheduled to check operating stuffing boxes to ensure that there are no leaks, to eliminate or minimize any leakage that is occurring, and to replace stuffing boxes when necessary. Leakage of a stuffing box thus represents a significant cost of recovering oil from wells which are driven by a downhole pump and a powered sucker rod.

U.S. Pat. No. 4,372,379 discloses a drive assembly for powering a downhole rotary pump. The drive motor is not directly over the wellhead, and FIG. 3 discloses the bearings and seals for sealing fluid within the wellhead. U.S. Pat. No. 4,647,050 discloses a stuffing box for a sucker rod pump, and U.S. Pat. No. 5,217,068 discloses another version of a stuffing box for a rotary rod string. U.S. Pat. No. 5,327,961 discloses a drive head for a rotary downhole pump.

U.S. Pat. No. 5,343,944 discloses a self aligning stuffing box for a pump-jack unit. U.S. Pat. No. 5,567,138 discloses a technique for limiting eccentric deviations of a rotating rod string in a pumping application. U.S. Pat. No. 5,791,411 discloses a wellhead stuffing box for a rotating rod string. U.S. Pat. No. 5,865,245 discloses a stuffing box gland for use with a rod string. U.S. Pat. No. 6,637,509 discloses a wellhead stuffing box support assembly positioned between a production pumping tree and a stuffing box of a wellhead.

U.S. Pat. No. 6,843,313 discloses a pump drive head with a stuffing box, and U.S. Pat. No. 7,044,217 discloses a stuffing box for a PC pump drive. U.S. Pat. No. 7,055,593 discloses a stuffing box with packing cones for a seal.

The disadvantages of the prior art are overcome by the present invention, and an improved sealed drive for powering a rotating sucker rod string which drives a downhole progressive cavity pump is hereinafter disclosed.

SUMMARY OF THE INVENTION

In one embodiment, a drive assembly for powering a rotating rod string in a well having a surface wellhead includes a motor having a drive shaft, and a torque conveying housing below the motor and containing a radially outer member supporting a plurality of outer member magnets. A non-magnetic pressure bearing housing includes an upper plate, a radially intermediate member extending downward from the upper plate, and a lower end seal to the wellhead. A radially inner member supporting a plurality of inner member magnets is rotatable within the intermediate member. Magnetic forces between the plurality of outer member magnets and the plurality of inner member magnets rotate the inner member magnets and thus the radially inner member when the motor rotates the outer member. A drive shaft connects the radially inner member and the sucker rod for rotating the sucker rod.

In another embodiment, the drive assembly for powering a rotating rod string in a well having a surface wellhead includes a torque conveying housing below the motor and containing a radially outer member supporting a plurality of outer member magnets. The radially inner member supporting a plurality of inner member magnets allows magnetic forces between the magnets to rotate the inner member magnets and thus the inner member as the outer member rotates. The radially inner member is rotationally connected to the sucker rod for rotating a sucker rod. A motor within the torque conveying housing rotates the radially outer member, and a pressure bearing housing above the torque conveying housing seals fluid pressure within the wellhead.

It is a feature of the invention to provide a drive for powering a progressive cavity pump which utilizes static rather than dynamic seals for sealing pressure within the wellhead. A related feature of the invention provide an improved drive for powering a rotating rod string to drive a progressive cavity pump wherein the maintenance required to seal fluid at the wellhead is significantly reduced.

These and further features and advantages of the present invention will become apparent from the following detailed description, wherein reference is made to the figures in the accompanying drawings.

DETAILED DESCRIPTION OF PREFERRED EMBODIMENTS

Figure 1:
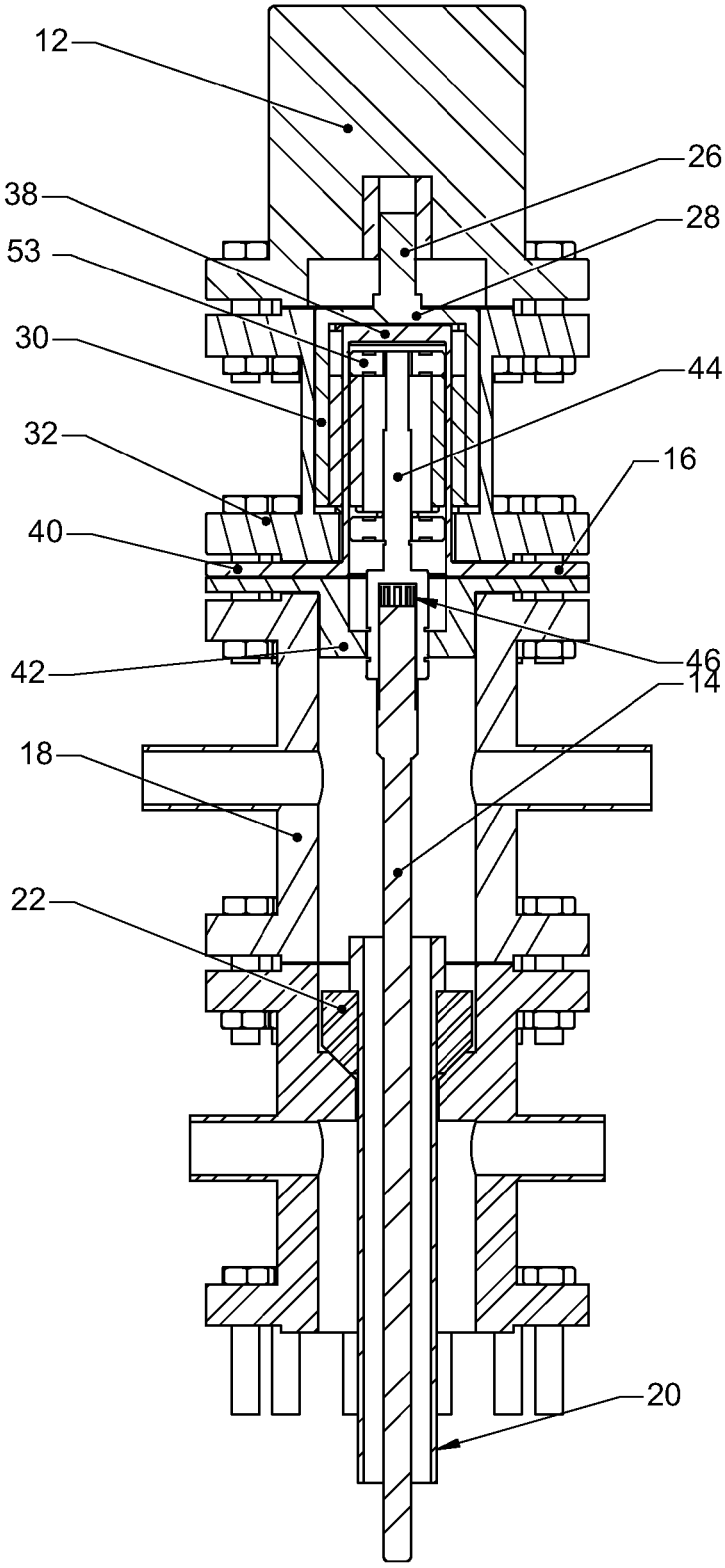
FIG. 1 is a side view, partially in cross-section, of the components of a drive assembly according to the present invention.

FIG. 1 illustrates one embodiment of a drive between the motor 12 and the upper end of sucker rod 14. In this case, fluid pressure is blocked from the ambient environment by the non-magnetic pressure bearing housing 16. A magnet coupling is driven by the motor 12, which may be either a hydraulic or electric motor. A conventional wellhead 18 thus receives therein the sucker rod 14, which powers a downhole pump which pumps fluid to the surface through tubing string 20, which is positioned on hanger 22 within the wellhead.

Motor 12 is thus concentrically positioned over the wellhead, and drives an outer housing 24 which has an upper shaft end 26, an upper top plate section 28, and a sleeve-shaped lower section 30 positioned within the torque conveying housing 32. The outer housing 24 supports a plurality of circumferentially arranged outer magnets 34, which are radially outward from the sleeve portion 36 of the pressure bearing housing 16. The pressure bearing housing 16 includes an upper plate section 38, a sleeve-shaped portion 36 extending downward from the upper plate 38, and a lower section 40 secured to torque conveying housing 32. In this case, the lower section 40 is a flange section, which is sandwiched between a lower surface of the lower flange on the torque conveying housing 32 and the upper surface of support housing 42, which in turn rests on top of the upper surface of the wellhead 18. The lower section of the pressure bearing housing 16 is thus sealed to the torque conveying housing and the support housing 42 to prevent fluid from leaking out of the wellhead.

Figure 1A:
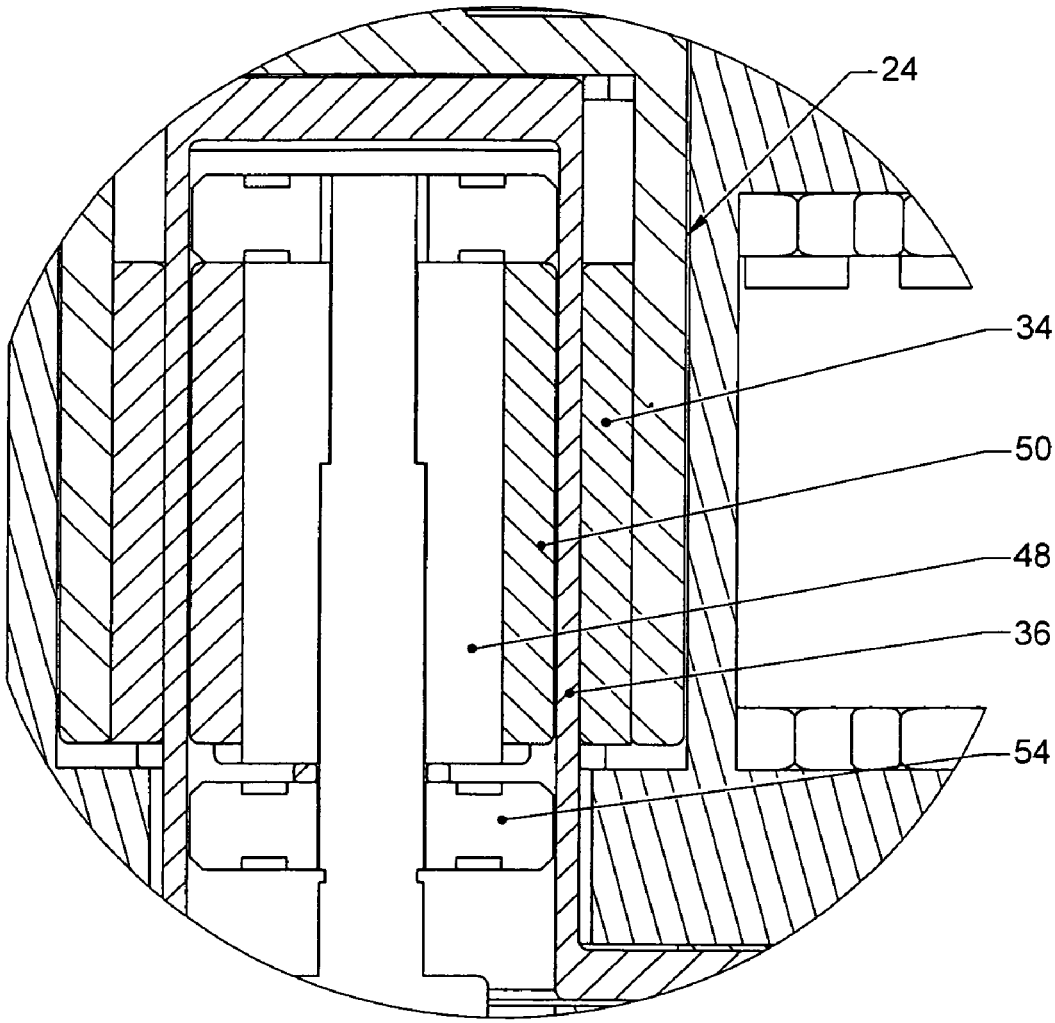
FIGS. 1A, 1B, and 1C are each enlarged cross-sectional views of a portion of the drive assembly shown in FIG. 1.

A coupling drive shaft 44 extends upward from the sucker rod 14, and includes a spline connection 46 for axial movement of the coupling drive shaft with respect to the upper end of the sucker rod. Mechanisms other than splines may be used for this adjustment purpose. A rotor sleeve 48 as shown in FIG. 1A is positioned circumferentially about the coupling drive shaft 44, and supports a plurality of circumferentially spaced inner magnets 50 thereon. A top bearing 53 and a lower bearing 54 guide rotation of the coupling drive shaft and thus the rotor 48 with respect to the torque conveying housing. Rotation of the outer magnets 34 by the motor 12 thus transmits torque through the non-magnetic pressure bearing housing 16 so as to rotate the inner magnets 50 and thus the rotor 48, which in turn rotates the coupling drive shaft 44 and the sucker rod 14. The support housing 42 is sandwiched between the flange 40 of the pressure bearing housing 16 and the upper end of the wellhead 18, and provides support for the coupling drive shaft 44 and thus support for the sucker rod 14 secured thereto.

Figure 1B:
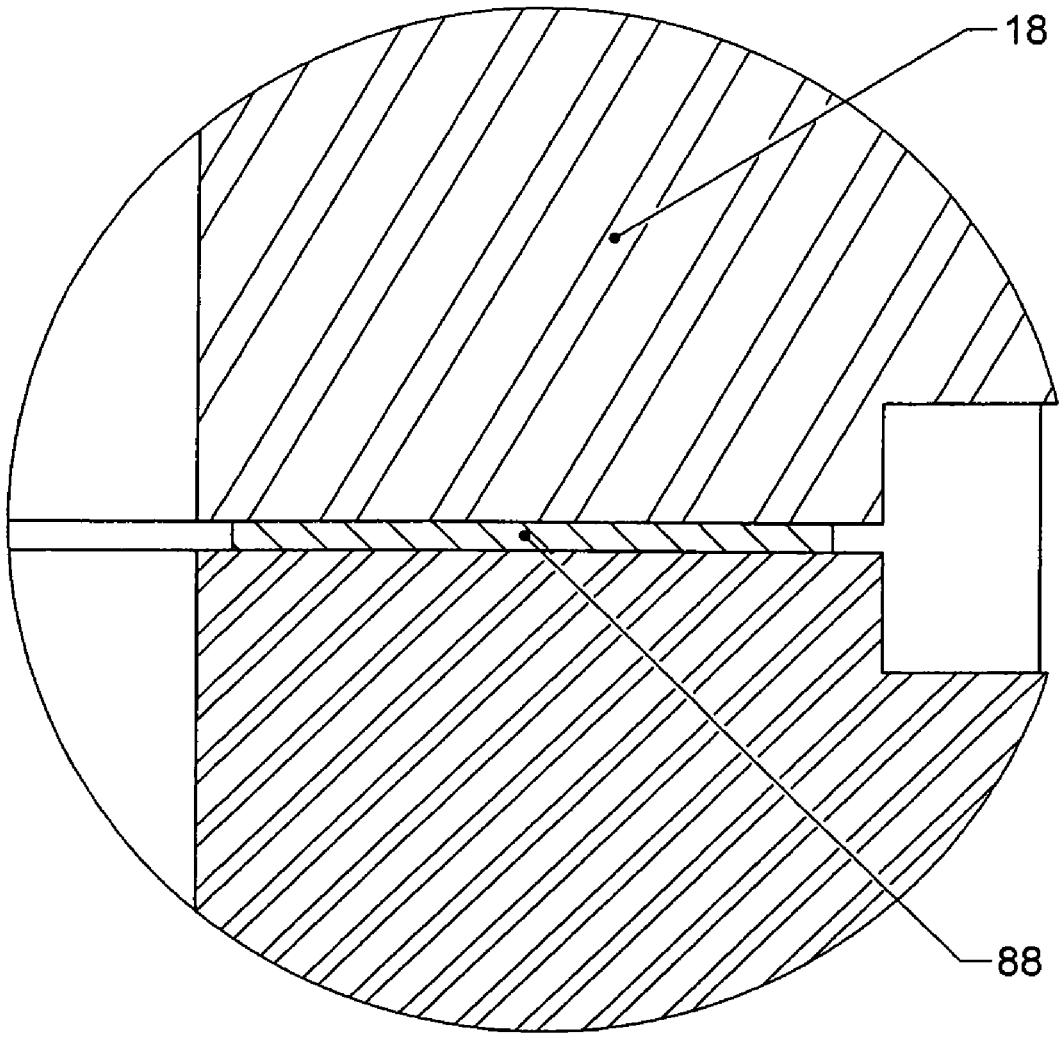
Figure 1C:
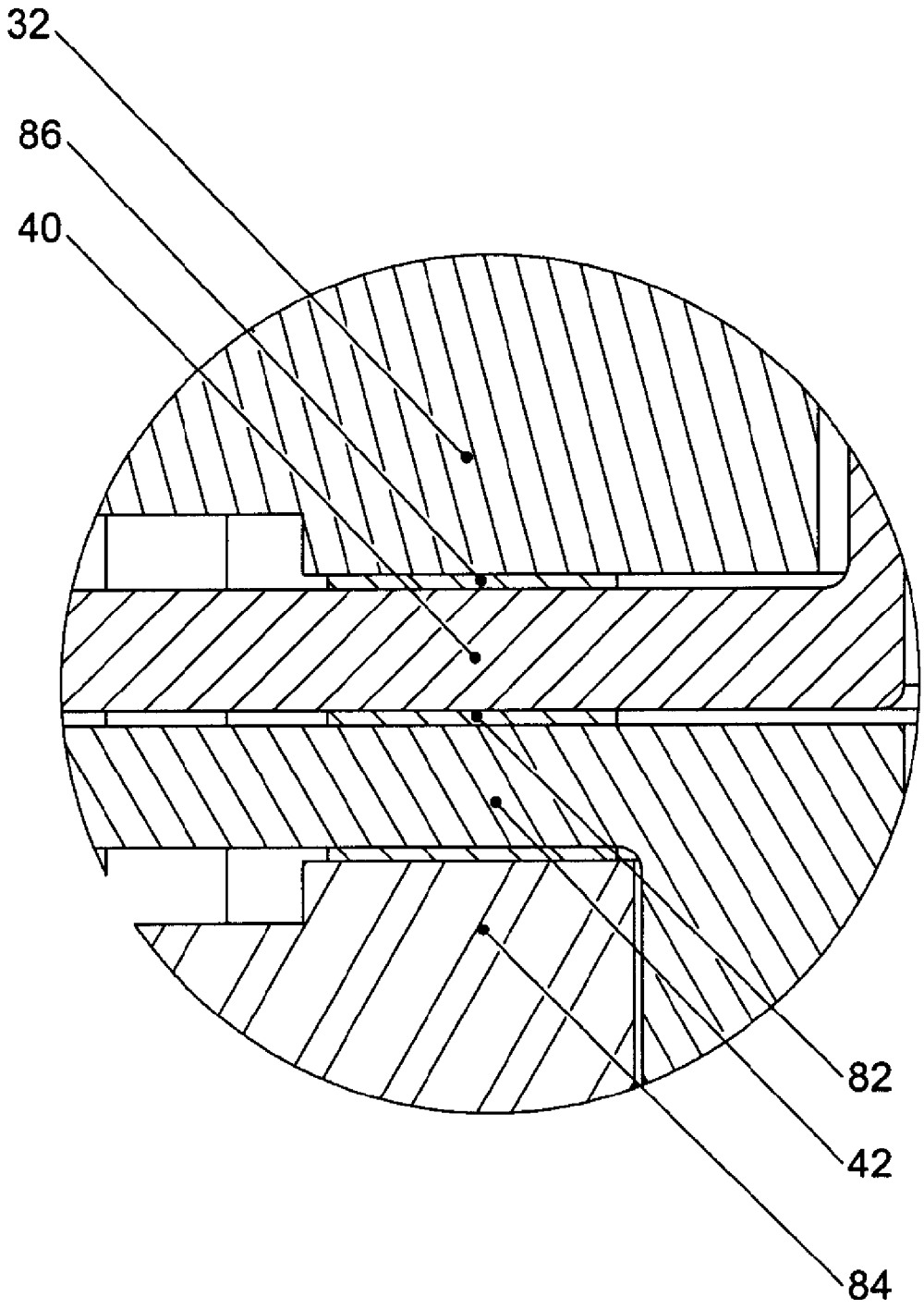

As shown in FIG. 1C, the flange section 40 of the pressure bearing housing 16 is sealed to the support housing 42 by static seal 82. Likewise, the support housing 42 is sealed to the wellhead 18 by static seal 84. Although not needed for pressure containment, the torque conveying housing 32 may be sealed to the flange section 40 of the pressure bearing housing 16 by static seal 86 for mitigation of ingress of debris at the well site. As illustrated in FIG. 1B, the flanged section within the wellhead 18 is sealed by static seal 88.

Figure 2:
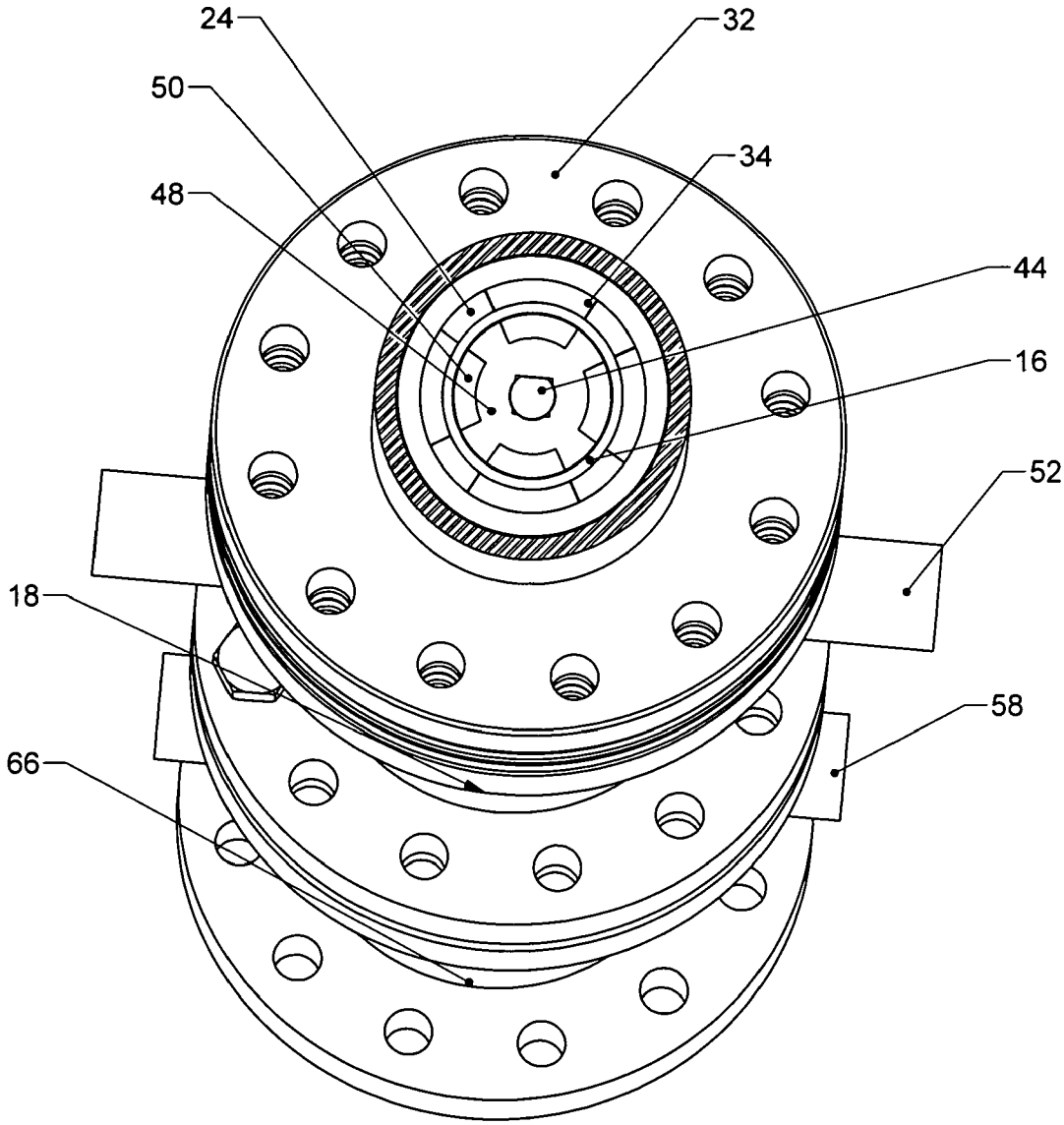
FIG. 2 illustrates the coupling between adjacent magnets.

FIG. 2 illustrates how the inner and outer magnets of the device align themselves. FIG. 2 further illustrates the non-magnetic pressure bearing housing. Circumferentially spaced inner magnets 50 and the circumferentially spaced outer magnet 34 may thus become aligned, such that rotation of the outer magnets transmits magnetic forces through the non-magnetic pressure bearing housing 16 to the inner magnets, thereby rotating the rotor 48 and thus the drive shaft 44. The portion 36 of the pressure bearing housing 16 is preferably relatively thin so that the attracting forces of the magnets are maximized. FIG. 2 further illustrates one or more recovery tubes 52 extending from the wellhead 18, and/or similar tubes 58 extending from the lower wellhead 18, for transferring pumped fluid to a suitable recovery location.

FIGS. 1 and 2 further illustrate how the motor 12 may be removed to expose the upper end of the outer housing 24. The torque conveying housing 32 along with the outer housing 24 and the outer magnets 34 may then be removed, thereby exposing the pressure bearing housing 16. Pressure bearing housing 16 may similarly be removed to expose the rotor 48 and the inner magnets 50, as well as the upper end of the drive shaft 44. The significant feature of the invention is that all seals which retain fluid within the drive assembly may be static seals, and in fact may be static seals between the lower flange of the torque conveying housing, the pressure bearing housing, support housing, and the wellhead. The pressure bearing housing 16 may be fabricated from iconel, or any other suitable non-magnetic material.

Incorporating a magnetic coupling into a PC drive mechanism is certainly feasible with commercially available couplings. Should greater torques be required, one may increase the axial length of the drive assembly, thereby adding more magnets, or increasing the diameter of the drive unit by using larger magnets.

The present invention essentially eliminates a conventional stuffing box and associated problems. Rather than use a conventional motor/frame that creates a large eccentrically located device on top of the wellhead, the proposed drive assembly offers a lighter motor and drive with its weight centralized above the wellhead. The centralization of the motor/drive over the wellhead will offer much greater safety in handling during installation and maintenance.

The drive of the present invention may be much lighter than prior art designs. By providing a hydraulic motor, high voltage and high electrical current can be removed from the critical explosion area near the wellhead. No electrical signal or current would have to be transmitted into the pressurized zone of the wellhead. Standard off-the-shelf motors may be adapted to the design, and the pressure is contained with static seals.

Figure 3:
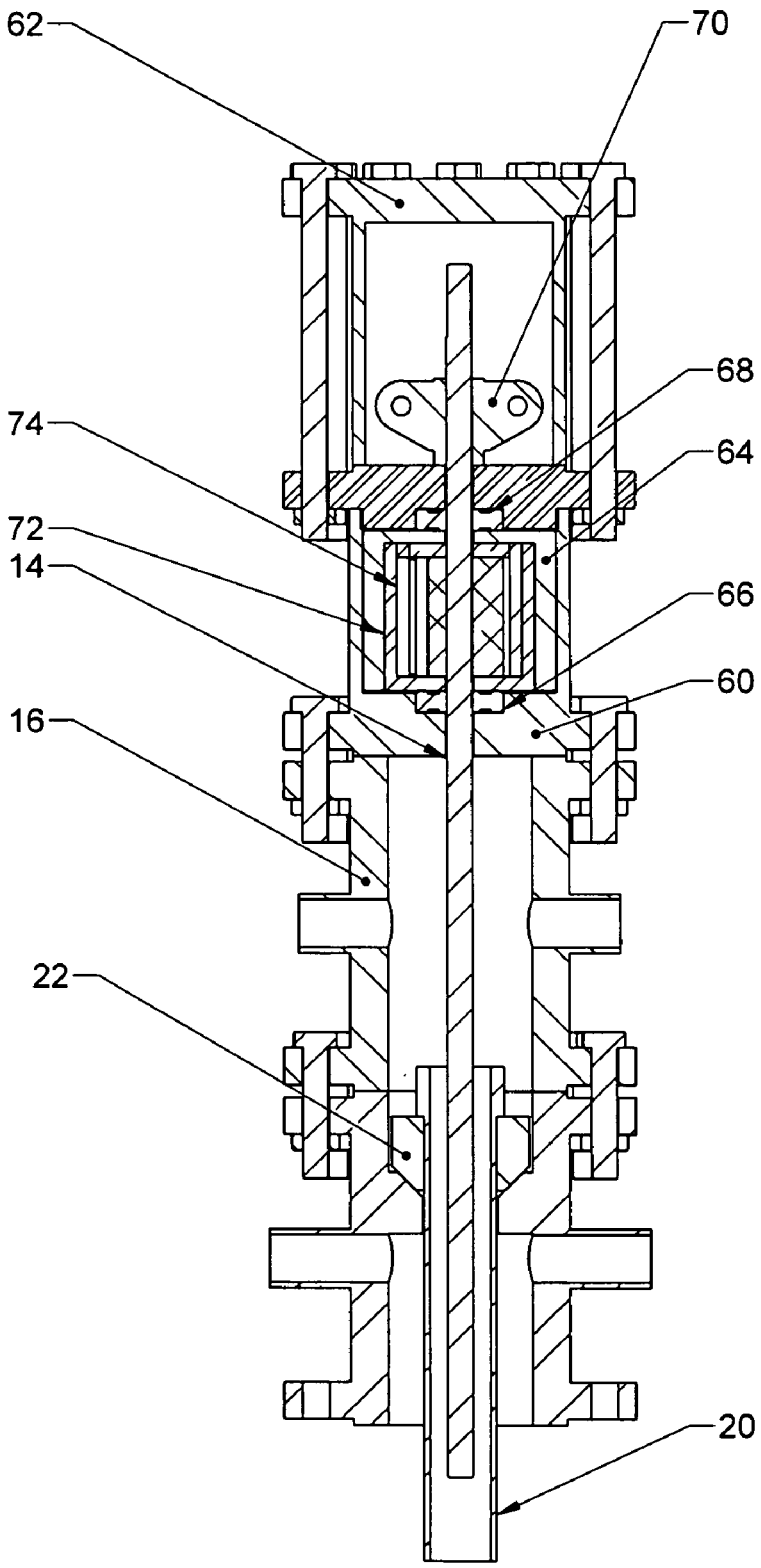
FIG. 3 illustrates another embodiment of the invention.

FIG. 3 depicts another version of a drive assembly, which is also centrally located over the wellhead. Again, either a hydraulic or electric motor may be employed. In this design, the pressure bearing zone of the wellhead is incorporated above the motor.

In the FIG. 3 embodiment, the sucker rod 14 extends upward through the pressure bearing housing 60 which contains an electric motor 64, and into the upper pressure bearing housing 62 which contains a sucker rod adjustment device 70. The sucker rod adjustment device 70 has ears for rotating the device, thereby axially lowering or raising the sucker rod which is threaded to the device 70. Upper bearing 68 and a lower bearing 66 centralize the sucker rod within the pressure bearing housing 60 and thus within the electric motor 64 contained in this housing. Torque is transmitted to the sucker rod via the outer sleeve 72 which houses a plurality of circumferentially spaced outer magnets, while the inner sleeve 74 supporting a plurality inner magnets rotates with the rod string 14. The electric motor 64 thus rotates the outer sleeve 72, thereby rotating the inner sleeve 74 and thus rotating the sucker rod 14. Fluid pressure is contained within the pressure bearing housing 60, but may pass upward through the motor and into the upper pressure bearing housing 62.

The sucker rod 14 thus extends through the motor 64, thereby allowing a region above the motor for placement of the sucker rod height adjustment device 70. The pressure bearing housing 62 offers a sealing boundary for any pressure inside the wellhead 18.

For this embodiment, torque is transmitted from the motor to the sucker rod via a magnetic coupling. The motor is specifically designed with a hollow region along its central axis for accepting the sucker rod, and drives the outer portion of a concentric magnetic coupling. The radially inner portion of the magnetic coupling is mechanically fixed to the sucker rod. In this case, there is no pressure boundary between the coupled sets of magnets, thereby maximizing the efficiency of the magnetic coupling. All seals for this configuration may be static seals.

Figure 4:
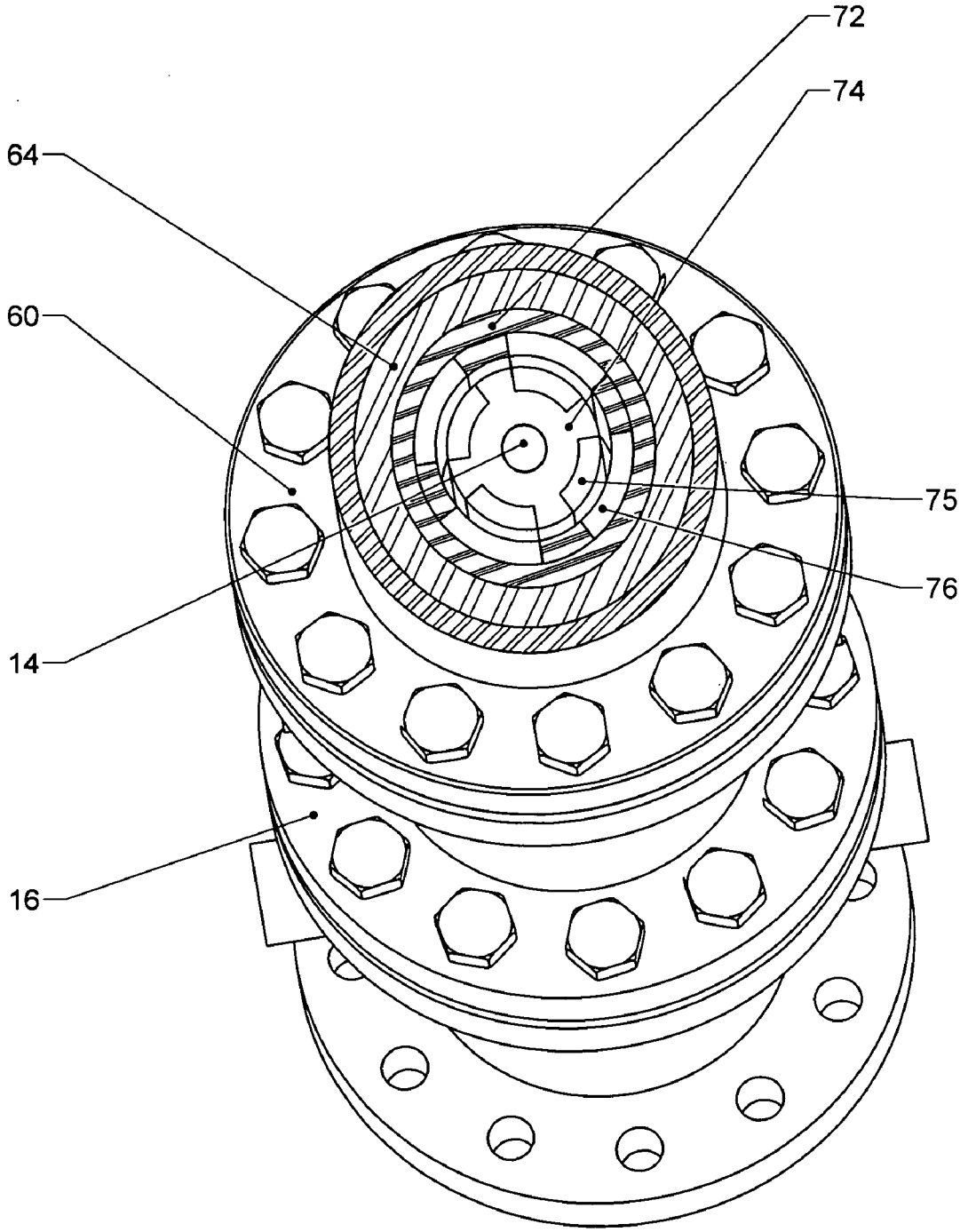
FIG. 4 is a side view, partially in cross-section, illustrating the coupling between the inner and outer magnets.

FIG. 4 illustrates the components within the pressure bearing housing 60. As with the prior embodiment, each of these housings, 72 and 74, carries a respective plurality of magnets, with the outer housing rotated by the motor 64, and the inner housing 74 rotated by the cooperative relationship between the inner magnets 75 and outer magnets 76, thereby rotating the sucker rod string 14.

This embodiment also eliminates a conventional stuffing box and its associated problems. The design may be easily centralized with the drive unit and the motor concentrically positioned over the wellhead. Variations of the sucker rod length may be handled by conventional sucker rods adjustment height mechanism.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A drive assembly for powering a rotating rod string in a well having a surface wellhead, comprising:

a fluid containing housing for containing fluid in the well and enclosing a radially inner member supporting a plurality of inner member magnets;

an outer member having a plurality of outer member magnets;

a motor for rotating the outer member, the motor being positioned longitudinally along a length of the plurality of outer member magnets;

the radially inner member supporting the plurality of inner member magnets being rotatable within the outer magnets, magnetic forces between the plurality of outer member magnets and the plurality of inner member magnets rotating the inner member magnets and the radially inner member when the motor rotates the outer member; and the radially inner member connected to the rod string for rotating the rod string when the radially inner member rotates.

2. A drive assembly as defined in claim 1, wherein the motor has an axis is substantially aligned with a central axis of the wellhead.

3. A drive assembly as defined in claim 1, further comprising:

a support housing positioned on the wellhead for providing vertical support to the rod string.

4. A drive assembly as defined in claim 1, further comprising:

an axial adjustment mechanism within an upper pressure bearing housing above the fluid containing housing for adjusting an axial position of the rod string relative to the wellhead.

5. A drive assembly as defined in claim 1, wherein the rod string passes longitudinally through the motor to a position above the motor.

6. A drive assembly for powering a rotating rod string in a well having a surface wellhead, comprising:

a fluid containing housing for containing fluid in a well and enclosing a radially outer member supporting a plurality of outer member magnets, the outer member rotated by a motor within the fluid containing housing;

a radially inner member within the fluid containing housing supporting a plurality of inner member magnets, magnetic forces between the plurality of outer member magnets and the plurality of inner member magnets rotating the inner member magnets and the radially inner member when the motor rotates the outer member;

the radially inner member being rotationally connected to the rod string for rotating the rod string; and the motor has an axis substantially aligned with a central axis of the wellhead, and the motor is positioned longitudinally along a length of the plurality of outer member magnets.

7. A drive assembly as defined in claim 6, further comprising:

each of the motor, the outer member, and the inner member are substantially concentric with a central axis of the rod string.

8. A drive assembly as defined in claim 6, further comprising:

a pressure bearing housing above the fluid containing housing for sealing fluid pressure within the wellhead.

* * * * *

UNITED STATES PATENT AND TRADEMARK OFFICE

CERTIFICATE OF CORRECTION

PATENT NO. : 7,784,534 B2
APPLICATION NO. : 12/077602
DATED : August 31, 2010
INVENTOR(S) : Billy W. White It is certified that error appears in the above-identified patent and that said Letters Patent is hereby corrected as shown below:

Column 5, line 41, please remove the word "is".

Signed and Sealed this

Fifth Day of October, 2010

David J. Kappos

David J. Kappos
*Director of the United States Patent and Trademark Office*